US005821676A

United States Patent [19]

Atchinson, II et al.

[11] Patent Number: 5,821,676

[45] Date of Patent: Oct. 13, 1998

[54] SPARK PLUG WITH GROOVED, TAPERED CENTER ELECTRODE

[75] Inventors: Ray William Atchinson, II; Dale Lavern Freed, Jr., both of Grand Blanc; John Franklin Mc Keon, Jr., Swartz Creek; Donald Robert Van Uum, Davison; Charles Dale Oakley, Lapeer; Gamdur Singh Mann, Grand Blanc; Keith Allen Penney, Davison, all of Mich.

[73] Assignee: General Motors Corporation, Detroit, Mich.

[21] Appl. No.: 616,788

[22] Filed: Mar. 15, 1996

Related U.S. Application Data

[63] Continuation of Ser. No. 304,332, Sep. 12, 1994, abandoned.

[51] Int. Cl.[6] ..... H01T 13/20

[52] U.S. Cl. ..... 313/140; 313/141

[58] Field of Search ..... 313/140, 141

[56] References Cited

U.S. PATENT DOCUMENTS

| | | | |
|---|---|---|---|
| 1,155,514 | 10/1915 | Schmidt | 313/140 |
| 1,318,529 | 10/1919 | Berlioz | 313/140 |
| 1,347,874 | 7/1920 | Rich | 313/141 |
| 1,538,870 | 5/1925 | Champion | 313/140 |
| 1,568,621 | 1/1926 | Rabezzana | 313/142 |
| 1,840,437 | 1/1932 | Dewar | 313/141 |
| 1,943,674 | 1/1934 | Woods-Humphrey et al. | 313/140 |
| 2,835,726 | 5/1958 | Beesch | 174/152 F |
| 2,946,912 | 7/1960 | Christenson | 313/141 |
| 3,345,532 | 10/1967 | Mattarella | 313/143 |
| 3,346,760 | 10/1967 | Jalbing et al. | 313/136 |
| 3,349,275 | 10/1967 | Blum et al. | 313/136 |
| 3,509,403 | 4/1970 | Kron | 313/121 |
| 3,659,137 | 4/1972 | Cataldo | 313/141 |
| 3,790,842 | 2/1974 | Westenkirchner et al. | 313/118 |
| 4,465,952 | 8/1984 | Sato et al. | 313/136 |
| 4,465,956 | 8/1984 | Sato et al. | 313/136 |
| 4,670,684 | 6/1987 | Kagawa et al. | 313/141 |
| 4,893,051 | 1/1990 | Kondo | 313/141 |
| 4,906,889 | 3/1990 | Dibert | 313/126 |
| 4,914,344 | 4/1990 | Watanabe et al. | 313/141 |
| 4,970,426 | 11/1990 | Bronchart | 313/141 |
| 5,159,232 | 10/1992 | Sato et al. | 313/141 |
| 5,264,754 | 11/1993 | Hanitijo et al. | 313/139 |
| 5,310,373 | 5/1994 | Treiber et al. | 445/7 |
| 5,373,214 | 12/1994 | McCready | 313/142 |

FOREIGN PATENT DOCUMENTS

| | | | |
|---|---|---|---|
| 0164613 | 6/1984 | European Pat. Off. | H01T 13/20 |
| 58214675 | 12/1983 | Japan | F02P 15/00 |
| 198345 | 3/1924 | United Kingdom | 313/141 |
| 491837 | 9/1938 | United Kingdom | 313/141 |
| 2189545 | 4/1986 | United Kingdom | H01T 13/20 |

OTHER PUBLICATIONS

S. Pischinger, et al., "How Heat Losses to the Spark Plug Electrodes Affect Flame Kernel Development in an SI–Engine", SAE Paper No. 900021 (1990).

*Primary Examiner*—Mark R. Powell
*Attorney, Agent, or Firm*—Cary W. Brooks

[57] ABSTRACT

The invention includes a spark plug for a combustion engine including a center electrode having a tapered portion with a plurality of ridges formed thereon. The spark plug may also include a tapered, ground electrode positioned over the center of the center electrode. The tapered center and ground electrodes allow for flames to propagate freely from the spark gap into the combustion chamber and to ignite an air-fuel mixture in the chamber leading to smooth idle and faster starts.

11 Claims, 3 Drawing Sheets

SPARK PLUG WITH GROOVED, TAPERED CENTER ELECTRODE

This is a continuation of application Ser. No. 08/304,332 filed on 12 Sep. 1994, now abandoned.

FIELD OF THE INVENTION

This invention relates to spark plugs, and more particularly to a spark plug having a grooved, tapered center electrode.

BACKGROUND OF THE INVENTION

FIG. 1A illustrates a fragmentary view of the tip of a standard spark plug having a center electrode 10 and a ground electrode 12 which extends across the entire sparking surface 14 of the center electrode. The center electrode has a diameter of about 2.7 mm. FIG. 1B illustrates a fragmentary view of the tip portion of a spark plug which has a very thin center electrode 16. The center electrode has a diameter about 1 mm. Spark plugs having small electrodes as shown in FIG. 1B have been known for years to lower sparking (demand) voltage across the plug gap and provide for more efficient, stable ignition and lower exhaust emissions relative to conventional spark plugs with larger electrodes as shown in FIG. 1A. Further, spark plugs with smaller electrodes have been shown to have reduced heat loss to the electrode and thereby extend the stable operating regime of the engine. Further, smaller electrodes have been shown to reduce the required minimum sparking energy significantly.

Spark plugs having electrodes with sharp edges or projections have been known to also lower demand voltage across the plug gap and provide more consistent, stable ignition and lower exhaust emissions relative to conventional plugs with larger electrodes. The sharp edges are typically generated by forming, trimming or adding projections to the flat center electrode surface. Aligning the end of the ground electrode with the middle of the center electrode (clip gap) is also known to accomplish this result. However, because of the reduced sparking surface area in many of these designs, the gap increases more rapidly with use and can lead to shortened plug life and decreased benefits.

Spark plugs having an extended firing location (projection of the electrodes into the combustion chamber) have been known for years to improve gas mileage and to increase power for passing. This is accomplished because the closer the spark comes to the center of the combustion chamber the faster the combustion occurs. However, extending the firing location creates a longer ground electrode. Unfortunately, the longer ground electrode may become too hot and cause rapid gap increase or in the worst case, pre-ignition. This is because extending the ground electrode provides more surface area to collect heat and a longer heat flow path.

The present invention overcomes many of the disadvantages of the prior art.

SUMMARY OF THE INVENTION

The invention includes a spark plug for a combustion engine including a center electrode having a tapered portion with a plurality of ridges formed thereon. The spark plug may also include a tapered, ground electrode having a sparking edge positioned over the center of the center electrode. The tapered center and ground electrodes allow for flames to propagate freely from the spark gap into the combustion chamber and to ignite an air-fuel mixture in the chamber leading to smooth idle and faster starts.

These and other objects, features and advantages will become apparent from the following detailed description and appended claims and drawings.

DETAILED DESCRIPTION

Figure 2:
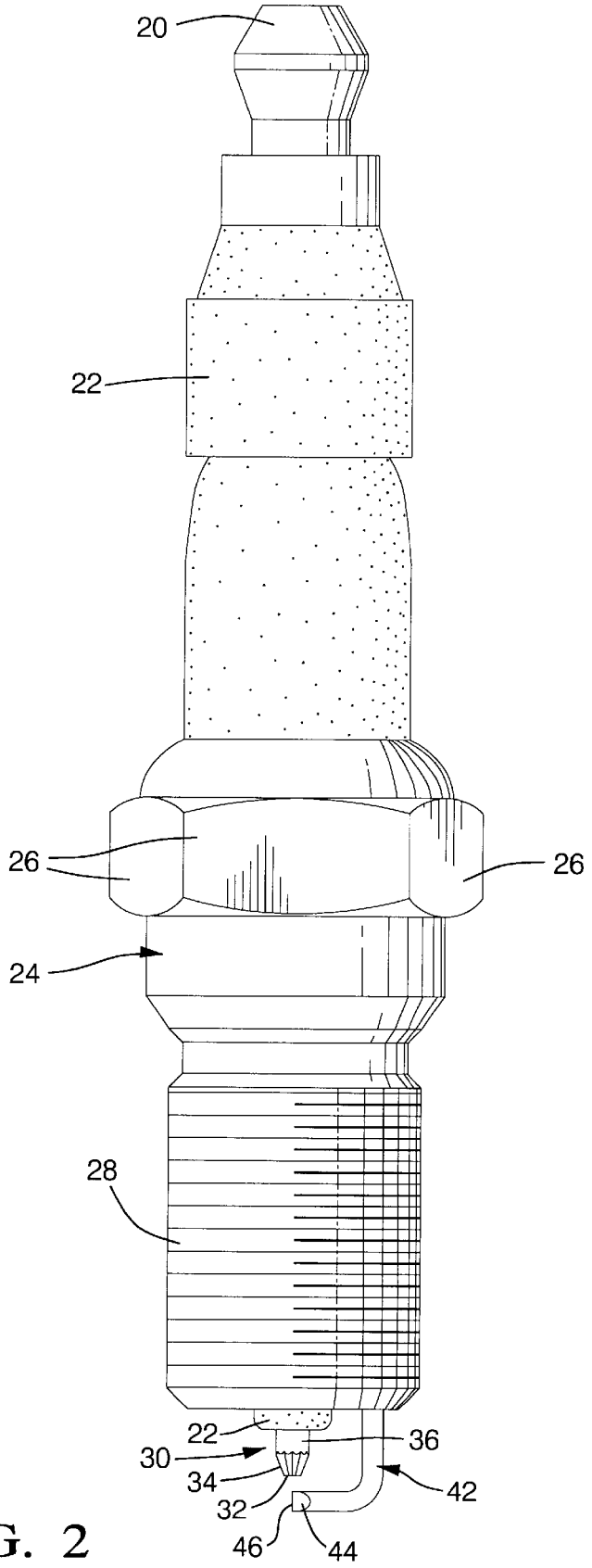
FIG. 2 illustrates a spark plug according to the present invention.

FIG. 2 illustrates a spark plug according to the present invention. The spark plug includes an electrode having a connector end 20 for engaging the boot of a spark plug wire which makes an electrical connection between the spark plug and an electrical power source. The electrode includes a core (not shown) in communication with the connector end of the electrode. An electrical insulator 22 surrounds the core of the electrode and is made from a material such as porcelain or ceramic. A portion of the insulator is covered with a metal shell 24. The metal shell includes flats 26 formed thereon for turning the spark plug with a wrench and a threaded portion 28 for engaging an associated threaded portion in the engine which form an access hole for the spark plug.

Figure 1A:
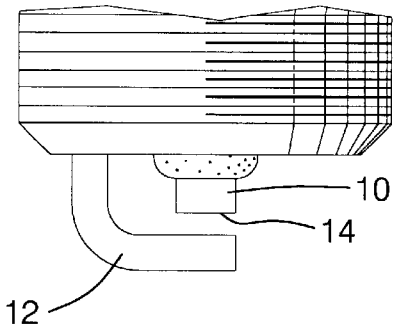
PRIOR ART FIG. 1A
FIGS. 1A and 1B illustrate a prior art standard spark plug and a spark plug with a thin center electrode, respectively.
Figure 1B:
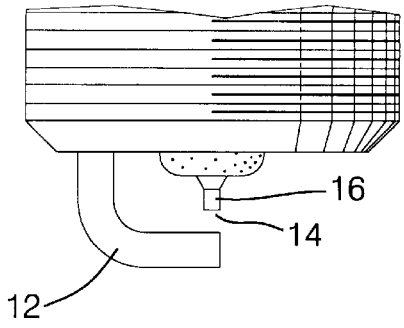
PRIOR ART FIG. 1B
Figure 3:
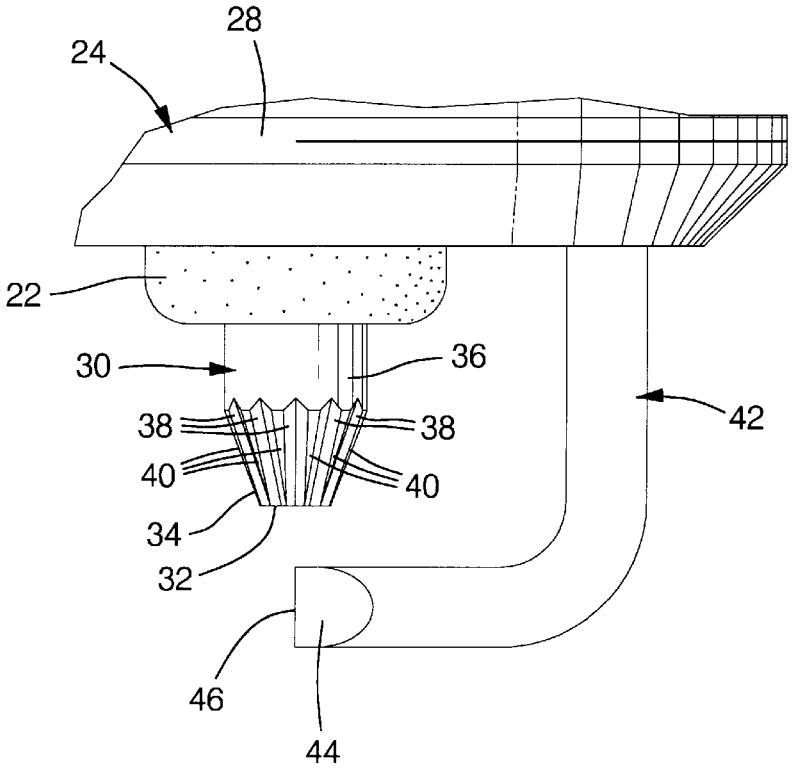
FIG. 3 is an enlarged, fragmentary view of a spark plug tip according to the present invention.

A center electrode 30 extends out away from the metal shell and is also in communication with the core. The center electrode has a flat surface 32 at one end and includes a tapered portion 34 extending from the flat surface to a cylindrical body portion 36 of the center electrode. The tapered surface has grooves 38 or knurls formed therein as shown in FIG. 3. Associated with the grooves are a plurality of ridges 40 extending from the flat end 32 of the center electrode and running substantially parallel to the longitudinal axis of the center electrode. The center electrode extends outwardly from the insulator 22 a distance ranging from about 2.6 to about 3.6 mm to provide an extending firing location which allows projection of spark location further into the combustion chamber for faster combustion resulting in better fuel economy and more power.

A ground electrode 42 is attached to the metallic shell and extends a distance sufficient to accommodate the extended firing location of the center electrode. The ground electrode has a tapered end 44 having an edge 46 which is positioned over and aligned with the center of the center electrode (i.e., the ground electrode is constructed and arranged so that a spark is formed from the ridges 40 on the tapered portion of the center electrode to a edge 46 of the ground electrode. Preferably the ground electrode is made from a nickel-silver material which overcomes the problem of prior art electrode in extended firing locations. The nickel-silver ground electrode material is more thermally conductive and thus resists erosion better than conventional materials and results in a longer electrode life. The erosion resistance improvement allows for other improvements to maintain their superior performance over the expected life of the plug.

The tapered center and ground electrodes allow for flame to propagate freely from the spark gap into the combustion chamber and to ignite the air-fuel mixture in the combustion engine. This leads to smooth idle and faster starts. The knurls or grooves in the taper of the center electrode reduce demand voltage by providing sharp edges or ridges 40 for spark initiation without sacrificing electrode life. Prior art designs raise the edges on the flat surface of the center electrode. However, these small surface areas erode more rapidly than the present invention, thus increasing the gap and demand voltage. The present invention overcomes these deficiencies by placing the grooves and associated ridges of substantial length along the tapered portion of the center electrode.

Again, the extended firing location is made possible by the nickel-silver ground electrode. This material conducts more heat out of the ground electrode and prevents pre-ignition. By projecting the spark location further into the combustion chamber, faster combustion occurs resulting in better fuel economy and more power.

Figure 4:
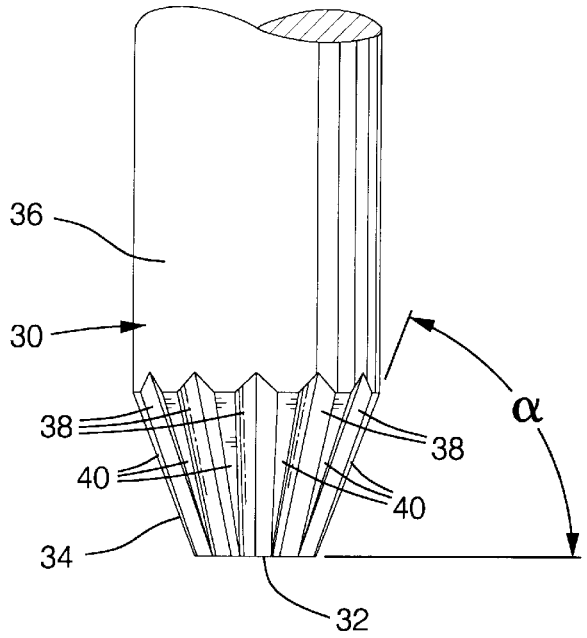
FIGS. 4 and 5 are enlarged illustrations of a center electrode including a tapered portion with a plurality of ridges according to the present invention.
Figure 5:
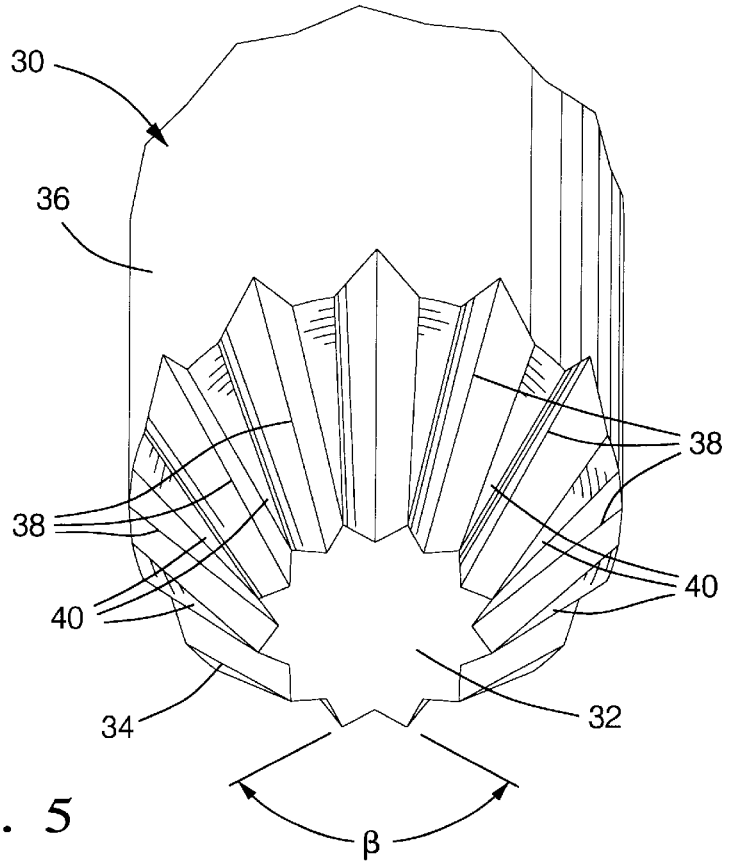

FIGS. 4 and 5 illustrate a center electrode according to the present invention. The center electrode includes a tapered portion 34 which may be formed at an angle a ranging from about 67 to about 57 and preferably about 62 degrees. The length of the tapered portion may vary but preferably is about 1.5 mm for a center electrode having a diameter of about 2.2 to about 2.9 and preferably about 2.5 mm. A plurality of ridges 40 may be formed on the tapered surface of the center electrode but are preferably about 30 degrees from each other and have a length ranging from 2.2 to 2.9 mm. The flat surface of the center electrode preferably is about 1 mm. The grooves cut into the tapered portion of the center electrode preferably are made at an angle β of about 116 degrees at a depth ranging from 0.1 to 0.2 mm, preferably 0.135 mm.

The embodiments of the invention in which an exclusive property or privilege is claimed is defined as follows:

1. A spark plug for a combustion engine comprising:

a center electrode having a tapered portion with a plurality of ridges formed running in substantially the same direction as the longitudinal axis of the center electrode.

2. A spark plug for a combustion engine comprising:

a center electrode with a cylindrical body portion having a first cross-sectional area and a flat end portion having a smaller second cross-sectional area, and a tapered portion extending from the flat end portion to the cylindrical body portion, said tapered portion having a plurality of ridges extending from the flat portion to the body portion.

3. A spark plug for a combustion engine as set forth in claim 2 further comprising a ground electrode having a tapered end forming an edge, said edge being positioned over the center of the center electrode so that spark propagates from the ridges formed on the tapered portion of the center electrode to the edge of the tapered ground electrode.

4. A spark plug for a combustion engine as set forth in claim 3 wherein said ground electrode comprises a nickel-silver material.

5. A spark plug as set forth in claim 1 further comprising an insulator surrounding said center electrode and a metal shell surrounding a portion of said insulator, and a ground electrode attached to the metal shell, said ground electrode extending a distance sufficient to accommodate firing between the center electrode and the ground electrode, said ground electrode having an end tapered to a relatively narrow edge, said edge positioned over and aligned with the center electrode so that a spark is formed from the ridges on the tapered portion of the center electrode to the edge of the ground electrode, said edge running parallel to the longitudinal axis of the center electrode.

6. A spark plug as set forth in claim 2 wherein said tapered portion of said center electrode is formed at an angle ranging from about 57 to about 67 degrees with respect to the longitudinal axis of the center electrode.

7. A spark plug as set forth in claim 2 wherein said ridges formed on said center electrode are formed at an angle with respect each other of about 30 degrees.

8. A spark plug as set forth in claim 2 wherein said ridges formed on said center electrode are formed at an angle with respect to each other and so that said ridges converge on each other.

9. A spark plug for a combustion engine comprising:

a center electrode with a cylindrical body portion having a first diameter and an end portion having a second diameter smaller than the first diameter, and a tapered portion extending the cylindrical body portion and the end portion, said tapered portion having a plurality of ridges formed thereon.

10. A spark plug for a combustion engine comprising:

a center electrode with a cylinder body portion a flat end portion, and a tapered portion extending from the flat end portion to the cylinder body portion, said tapered portion having a plurality of ridges extending from the flat portion to the body portion.

11. A spark plug as set forth in claim 2 wherein said tapered portion of said center electrode is formed at an angle ranging from about 57 to about 62 degrees with respect to the longitudinal axis of the center electrode.

* * * * *